US010140846B2

(12) United States Patent
Rabb et al.

(10) Patent No.: US 10,140,846 B2
(45) **Date of Patent: *Nov. 27, 2018**

(54) SECURITY SYSTEM RE-ARMING

(71) Applicant: Google LLC, Mountain View, CA (US)

(72) Inventors: Laura Rabb, San Jose, CA (US); David Louis Warner, Woodside, CA (US); Jeffrey Alan Boyd, Novato, CA (US); Jeffery Theodore Lee, Los Gatos, CA (US); Mark Rajan Malhotra, San Mateo, CA (US); Kenneth Louis Herman, San Jose, CA (US); James Eric Mason, Mountain View, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/849,536

(22) Filed: Dec. 20, 2017

(65) Prior Publication Data

US 2018/0137744 A1 May 17, 2018

Related U.S. Application Data

(63) Continuation of application No. 14/937,806, filed on Nov. 10, 2015, now Pat. No. 9,870,698.

(51) Int. Cl.
*G08B 29/18* (2006.01)
*G08B 25/00* (2006.01)

(52) U.S. Cl.
CPC ..... *G08B 29/18* (2013.01); *G08B 25/008* (2013.01)

(58) Field of Classification Search
CPC ..... G08B 25/008; G08B 29/18; G08B 13/02
See application file for complete search history.

(56) References Cited

U.S. PATENT DOCUMENTS

| | | | | |
|---|---|---|---|---|
| 4,532,507 | A | 7/1985 | Edson et al. | |
| 6,104,288 | A | 8/2000 | Hopkins et al. | |
| 7,821,386 | B1 | 10/2010 | Barrett et al. | |
| 8,912,879 | B2 | 12/2014 | Fyke et al. | |
| 9,245,439 | B2 * | 1/2016 | Lamb | G08B 25/008 |
| 2007/0115092 | A1 * | 5/2007 | Hsu | G07C 9/00111 340/5.28 |
| 2010/0156591 | A1 * | 6/2010 | Newman | G08B 25/008 340/5.2 |
| 2013/0257611 | A1 * | 10/2013 | Lamb | G08B 25/008 340/501 |

* cited by examiner

*Primary Examiner* — Sisay Yacob
(74) *Attorney, Agent, or Firm* — Morris & Kamlay LLP

(57) ABSTRACT

Systems and techniques are provided for security system re-arming. Input invoking restricted credentials may be received. The security system of an environment may be changed from a first mode to a second mode based on the restricted credentials. The restricted credentials used to change the security system to the second mode may be determined to be near expiration based on an expiration condition of the restricted credentials. A notification may be sent to a person associated with the restricted credentials including a reminder to use the restricted credentials to change the security system to the first mode before the restricted credentials expire.

20 Claims, 10 Drawing Sheets

SECURITY SYSTEM RE-ARMING

BACKGROUND

Security systems may allow for the use of temporary, or scheduled, credentials. These credentials may allow a person to disarm the security system. The person may then remain in the area secured by the security system, such as a home, for as long as the credentials are valid. The restricted credentials may be used to allow guest access to a home secured by a security system.

BRIEF SUMMARY

According to an embodiment of the disclosed subject matter, input invoking restricted credentials may be received. The security system of an environment may be changed from first mode to a second mode based on the restricted credentials. The restricted credentials used to change the security system to the second mode may be determined to be near expiration based on an expiration condition of the restricted credentials. The expiration condition may indicate the amount of time for which the restricted credentials are valid after the restricted credentials are used to change the security system to the second mode. A notification may be sent to a person associated with the restricted credentials including an indication of the amount of time before the restricted credentials expire and a reminder to use the restricted credentials to change the security system to a first mode before the restricted credentials expire.

The restricted credentials used to change the security system to the second mode may be determined to be expired based on the expiration condition of the restricted credentials. The security system may be determined to be in the second mode that the security system was changed to based on the restricted credentials. A set of signals from one or more sensors distributed in the environment may be received. An occupancy estimate for the environment may be generated based on the set of signals from the one or more sensors.

It may be determined, based on the occupancy estimate, that there are no unauthorized occupants, including a person who invoked the restricted credentials, in the environment. It may be determined that the security system may be automatically changed from the second mode to a first mode. The security system may be automatically changed from the second mode to the first mode. It may be determined, based on the occupancy estimate, that there are no unauthorized occupants, including a person who invoked the restricted credentials, in the environment. It may be determined that the security system may not be automatically changed from the second mode to a first mode. A request to change the security system from the second mode to a first mode may be sent to a computing device associated with a user of the security system. A response to the request to change the security system from the second mode to the first mode granting the request may be received. The security system may be changed from the second mode to the first mode.

It may be determined, based on the occupancy estimate, that an unauthorized occupant is present in the environment after the expiration of the restricted credentials. A notification of the presence of the unauthorized occupant in the environment after the expiration of the restricted credentials and a request to extend the validity of the restricted credentials may be sent to a computing device associated with a user of the security system.

A response to the request to extend the validity of the restricted credentials granting the request may be received. The expiration condition of the restricted credentials may be changed to extend the validity of the restricted credentials. The restricted credentials may be un-expired.

A request to communicate with the unauthorized occupant of the environment through one or more output devices distributed in the environment may be received. Contact data for the unauthorized person may be sent to the computing device associated with the user with the notification of the presence of the unauthorized occupant in the environment after the expiration of the restricted credentials and the request to extend the validity of the restricted credentials.

The restricted credentials may be associated with a schedule. The schedule may specify one or more of times, days, and dates when the restricted credentials are usable to change the security system from a first mode to a second mode, and the number of times the restricted credentials may be used to change the security system to a second mode within a specified time period. The expiration condition of the restricted credentials is the occurrence of a specified time, the occurrence of a specified time on a specified day, the occurrence of a specified time on a specified date, or the elapsing of a specified amount of time from when the restricted credentials are used to change the security system to a second mode. The second mode based on the restricted credentials may include a mode of the security system wherein one or more sensors are second and one or more controls are adjusted to specified states. The sensors that are second and one or more of the controls that are adjusted may permit access to specified areas of the environment.

According to an embodiment of the disclosed subject matter, a means for receiving input invoking restricted credentials, a means for changing the security system of an environment from a first mode to a second mode based on the restricted credentials, a means for determining that the restricted credentials used to change the security system to the second mode are near expiration based on an expiration condition of the restricted credentials, wherein the expiration condition indicates the amount of time for which the restricted credentials are valid after the restricted credentials are used to change the security system to the second mode, a means for sending a notification to a person associated with the restricted credentials including an indication of the amount of time before the restricted credentials expire and a reminder to use the restricted credentials to change the security system to a first mode before the restricted credentials expire, a means for determining that the restricted credentials used to change the security system to the second mode are expired based on the expiration condition of the restricted credentials, a means for determining that the security system is in the second mode that the security system was changed to based on the restricted credentials, a means for receiving a set of signals from one or more sensors distributed in the environment, a means for generating an occupancy estimate for the environment based on the set of signals from the one or more sensors, a means for determining, based on the occupancy estimate, that there are no unauthorized occupants, including a person who invoked the restricted credentials, in the environment, a means for determining that the security system may be automatically changed from the second mode to a first mode, a means for automatically changing the security system from the second mode to the first mode, a means for determining, based on the occupancy estimate, that there are no unauthorized occupants, including a person who invoked the restricted credentials, in the environment, a means for determining that the security system may not be automatically changed from the second mode to a first mode, a means for sending a request to change the security system from the second mode to a first mode to a computing device associated with a user of the security system, a means for receiving a response to the request to change the security system from the second mode to the first mode granting the request, a means for changing the security system from the second mode to the first mode, a means for determining, based on the occupancy estimate, that an unauthorized occupant is present in the environment after the expiration of the restricted credentials, a means for sending a notification of the presence of the unauthorized occupant in the environment after the expiration of the restricted credentials and a request to extend the validity of the restricted credentials to a computing device associated with a user of the security system, a means for receiving a request to communicate with the unauthorized occupant of the environment through one or more output devices distributed in the environment, and a means for sending contact data for the unauthorized person to the computing device associated with the user with the notification of the presence of the unauthorized occupant in the environment after the expiration of the restricted credentials and the request to extend the validity of the restricted credentials, are included.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
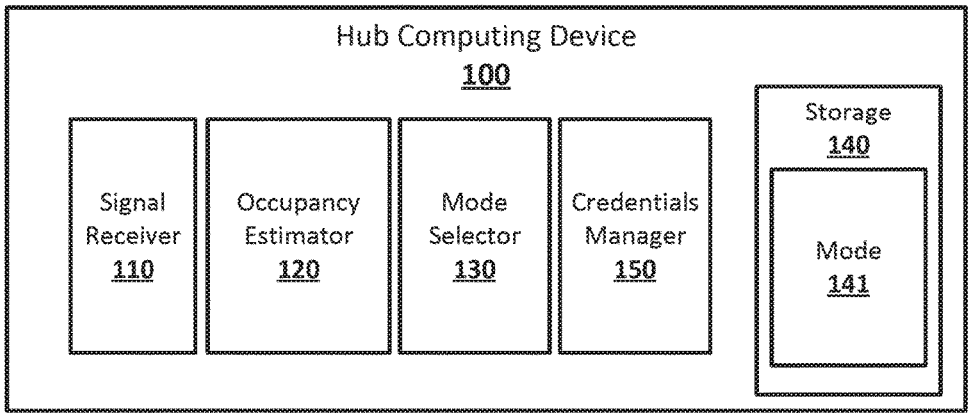
FIG. 1 shows an example system suitable for security system re-arming according to an implementation of the disclosed subject matter.

According to embodiments disclosed herein, security system re-arming may allow a smart home environment to determine when restricted credentials used to access the environment are about to expire and remind the user of the restricted credentials to re-arm the security system. The smart home environment may also automatically re-arm the security system when restricted credentials expire and their user has left the environment, or notify an appropriate party when restricted credentials expire and their user has not left the environment.

Security system re-arming may be used by the security system of a smart home environment to allow guests access through the use of restricted credentials while still ensuring that the security system is an armed mode when the restricted credentials expire. The environment may be, for example, a home, office, apartment, condo, or other structure, and may include a combination of enclosed and open spaces. A person may gain access to the environment using restricted credentials. The restricted credentials may allow for the security system to be placed in disarmed mode and may expire after some amount of time. Shortly before the restricted credentials expire, the person who used them may be notified that they should re-arm the security system before their restricted credentials expire. When the restricted credentials expire, signals may be received from sensors in the smart home environment to determine whether the person who used the restricted credential is still present in the environment, or whether some unauthorized person is present. The sensors may be, for example, low power motion sensors, such as a passive infrared sensor used for motion detection, light sensors, cameras, microphones, entryway sensors, smart light switches, mobile device scanners for detecting the presence of mobile computing devices or fobs via WiFi, Bluetooth, and RFID, and the like. The signals from the sensors may be used to generate an occupancy estimate for the environment for the environment, which may indicate whether the person who used the restricted credentials is still present in the environment. If the person who used the restricted credentials is no longer present, the security system may be automatically re-armed, or a request to re-arm the security system may be sent to an appropriate party. If the person who used the restricted credentials is still present, the appropriate party may be notified and may either extend the validity of the restricted credentials or may initiate communication with the person to determine why they are still present.

The smart home environment may include a hub computing device, which may be any suitable computing device for managing the smart home environment, including a security system of the smart home environment and automation system including other functions beyond security. The hub computing device may be a controller for a smart home environment. For example, the hub computing device may be or include a smart thermostat. The hub computing device also may be another device within the smart home environment, or may be a separate computing device dedicated to managing the smart home environment. The hub computing device may be connected, through any suitable wired and wireless connections, to a number of sensors distributed throughout an environment. For example, the hub computing device, sensors, and other components of the smart home environment may be connected in a mesh network. Some of the sensors may, for example, be motions sensors, including passive infrared sensors used for motion detection, light sensors, cameras, microphones, entryway sensors, smart light switches, as well as mobile device scanners that may use Bluetooth, WiFi, RFID, or other wireless devices as sensors to detect the presence of devices such as smartphones, tablets, laptops, or fobs. Sensors may be distributed individually, or may be combined with other sensors in sensor devices. For example, a sensor device may include a low power motion sensor and a light sensor, or a microphone and a camera, or any other combination of available sensors.

The smart home environment may include a security system, which may include any number of modes. The modes of the security system may include armed modes, such as away and vacation modes, and disarmed modes, such as home modes and guest access modes. When the security system is in an armed mode, the sensors in the environment may be considered armed. Signals from an armed sensor may be checked to determine if the sensor has been tripped. For example, an armed motion sensor may be tripped when it detects motion, and an armed entryway sensor may be tripped when the monitored entryway is opened or otherwise disturbed. The tripping of an armed sensor may result in the generation of an alarm, alert, or other such notification, as the tripping may indicate the presence of an unauthorized person or other intruder in the environment. Sensors that are disarmed may not be tripped. In some disarmed modes, certain sensors in the environment may be armed, while other sensors may be disarmed. For example, sensors monitoring external entryways may be armed, while sensors monitoring internal entryways and motion may be disarmed. This may allow, for example, alarms to be generated when someone tries to enter a home, while not having alarms set off by motion within the home. In some disarmed modes, sensors monitoring particular entryways may be armed, while others may be disarmed. For example, sensors monitoring the front door may be disarmed, while sensors monitoring other external entryways may be armed. The modes of the security system may also manage other controls throughout the smart home environment. For example, in some armed modes, a smart thermostat may be set to a low energy mode and smart light switches may be switched on an off to simulate the presence of occupants in the home to discourage potential intruders. The smart home environment may also control automated locks according to the mode of the security system, locking any unlocking the locks to permit and deny access to various areas of the environment.

Modes of the security system, and which sensors are armed and disarmed in those modes, may be specific to the environment in which the smart home environment is installed. For example, the night mode for a home may arm different sensors than the night mode for an office, as movement may be expected within a home at night, but not within an office.

A user of a smart home environment may wish to grant another person access to the environment. For example, an occupant or owner of a home may wish to grant access to a guest, such as, for example, a renter, a house sitter, a house keeper, a delivery driver, or a technician, when the occupant or owner is not present. The user may give the person restricted credentials that may allow for access to the environment by changing the security system to a disarmed mode. The input to use the restricted credentials may be entered into the security system as, for example, a PIN number or passcode, or biometric input such as a fingerprint or facial or voice recognition, or through use of a fob or identification of a personal computing device through, for example, Bluetooth or Wi-Fi signals, which may invoke the use of the restricted credentials in the security system. The input invoking the restricted credentials may be entered directly into the security system, for example, using a keypad, touchpad, fingerprint scanner, microphone, or camera that is part of or connected to a hub computing device, or may be entered through, for example, an application running on a mobile computing device such as a smartphone.

Restricted credentials may be associated with a schedule, which may include any suitable condition for expiration of the restricted credentials. Restricted credentials may be usable certain days or dates and within certain time periods and may be valid for any suitable time period, on a one-time or recurring basis. During times when a restricted credential is usable, that restricted credential may be used to disarm the security system of the smart home environment, and after being used, may be valid for a specified amount of time, or until a specified time, based on the condition for the expiration of the restricted credentials.

For example, the condition for expiration of a restricted credential may be a certain time. For example, restricted credentials for a house keeper who comes every Thursday from 9:00 am to 5:00 pm may be usable during those times, and may also be valid during those times, expiring at 5:00 pm every Thursday and becoming usable and valid again at 9:00 am the next Thursday. Restricted credentials may be usable and valid for any suitable time periods, which may or may not be of the same length. Restricted credentials may expire at a specific time on a specific date. For example, restricted credentials for a renter staying for a week may be usable and valid 24 hours a day for the week of the renter's stay, starting on the first day of that week and expiring at the end of that week, for example, at 12 pm on the date that the renter's stay ends. Restricted credentials may be usable within a given time period, and valid for some set amount of time after they are used, with the condition for expiration being the elapsing of that set amount of time. For example, the restricted credentials for the house keeper may be usable between 9:00 am and 1:00 pm every Thursday, and may be valid for 4 hours after they are used to disarm the security system. If the restricted credentials are used at 12 pm, they may remain valid until expiring at 4 pm. If they are used at 2 pm, they may be rejected, as they were only usable until 1:00 pm, and won't be usable again until 9:00 am the following Thursday. Restricted credentials may also be used some set number of times within a given time period. For example, a delivery driver may be given restricted credentials which may be used twice in a single day, or 24 hour period, but remain valid for only 1 minute after they are used to disarm the security system, giving the delivery driver enough time to open a door to a home and drop off a package before the restricted credentials expire. Restricted credentials may have a cumulative time limit. For example, restricted credentials may be valid for cumulative number of hours in a given time period, such as 8 hours per month, or 3 hour per week, but may otherwise be usable until the cumulative time limit is reached. The restricted credentials may expire and be unusable until the given time period resets, for example, until the next month or week. Restricted credentials may be valid for cumulative amounts of time based on a schedule. For example, restricted credentials may be usable between from 9:00 am to 5:00 pm daily, but may only be valid for a cumulative 3 hours within any 7 day period, after which they may expire and be unusable, even from 9:00 am to 5:00 pm, until the next 7 day period starts. This may allow restricted credentials to be give a person time-limited access to an environment with a security system.

The expiration condition for restricted credentials may also be, for example, resource usages. Resources may include any resources available within an environment, such as, for example, water, electricity, or any electrical or electronic device which operates on a timer such as, for example, a hot tub, tanning booth, or cryotherapy chamber. The restricted credentials may be usable on a schedule, or may always be usable, and may be valid until the specified amount of resources have been used. The restricted credentials may be considered to be near expiration, resulting a rearm reminder, when an amount of resources near the specified amount of resource in the expiration condition have been used. For example, restricted credentials which specify an amount of time of usage of a device may be near expiration when some percentage of the specified amount of time of usage has been used.

Restricted credentials may be associated with a disarmed mode of the security system. For example, restricted credentials given to a renter may disarm the front door of a house, but may keep a back door and certain internal doors armed, for example, allowing the owner to prevent the renter from accessing certain rooms. Restricted credentials given to a delivery driver may only disarm the front door of a house, leaving all other sensors armed. This may allow restricted credentials to be used to limit a person's physical access to specified areas of a smart home environment with a security system, based on which sensors are disarmed by the restricted credentials and which remain armed. Restricted credentials may be used, for example, to change the security system to an arm-in-stay mode.

Restricted credentials may be issued to an individual or a group, and may be associated with the individual or group to whom they are issued. Two different sets of restricted credentials may be issued to two different people, even if the access permitted by both sets of restricted credentials is the same, so that the hub computing device may determine who has disarmed the security system using restricted credentials. Restricted credentials may also be associated with contact data for a person to whom the credentials were issued. For example, restricted credentials issued to an individual may be associated with that individual's phone number, email address, messaging service handle, or any other suitable data that may allow the hub computing device to contact the individual directly.

After a person has used restricted credentials to change the security system to a disarmed mode, the hub computing device may monitor for the occurrence of the expiration condition for the restricted credentials. For example, if the restricted credentials expire 4 hours after being used, the hub computing device may monitor the amount of elapsed time since the restricted credentials were used to change the security system to a disarmed mode. When the restricted credentials are near expiration, the hub computing device may issue a re-arm reminder to the person who used the restricted credentials. The re-arm reminder may indicate to the person that their restricted credentials are near expiration, and that they should re-arm the security system, changing it back to an armed mode, before the restricted credentials expire. For example, the hub computing device may send a message to a personal computing device, such as smartphone, tablet, or wearable device, associated with the person, using contact data associated with the restricted credentials. The hub computing device may also use output devices of the smart home environment, such as, for example, speakers and screens distributed through a home, to issue audio and visual reminders. If the security system has already been re-armed, no reminders may be issued. The time before the expiration of the restricted credentials at which the reminder may be issued may be determined in any suitable manner, and may be based, for example, on the length of time for which the restricted credentials are valid. For example, if the restricted credentials are valid for only 1 minute after they are used, the reminder may be issued 25 seconds before expiration. If the restricted credentials are valid for 2 hours after they are used, the reminder may be issued 5 minutes before expiration.

Upon determining that the restricted credentials used to change the security system to a disarmed mode have expired, the hub computing device may determine if the security system was re-armed. If the security system was not re-armed, the hub computing device may determine if the person who used the restricted credentials is still present in the environment, or if some other unauthorized person is present. Signals from the sensors distributed throughout the environment may be sent to the hub computing device. The hub computing device may use signals received from the sensors to determine how many occupants, including people and pets, are in the environment, generating an occupancy estimate based on motion sensing, voice, face, and motion recognition through cameras, changing light levels reported by light sensors, turning on and off of smart light switches, and detection of computing devices, such as smartphone or tablets, or fobs associated with residents of the environment or guests in the environment, or pets.

When the occupancy estimate indicates that the person who used the restricted credentials is no longer present in the environment, the hub computing device may either automatically re-arm the security system, for example, changing the security system from a disarmed mode to an armed mode, or may request permission to re-arm the security system from an appropriate party. For example, if the hub computing device is permitted to automatically re-arm the security system, the hub computing device may change the security system to any suitable armed mode without any user intervention, for example, re-arming all sensors that were disarmed by the use of the restricted credentials, setting the thermostat to an appropriate level, dimming or turning off lights, relocking locks, and so on. A notification may be sent to an appropriate party, such as a user of the security system, for example, on a personal computing device such as a smartphone, indicating that automatic mode switch. If the hub computing device is not permitted to automatically re-arm the security system, the hub computing device may send a mode change request to an appropriate party, for example, a user of the security system such as a resident of a home, requesting authorization to change the security system to an armed mode. The mode change request may be sent to a personal computing device associated with the user, such as a smartphone. This may allow the user to change the mode of the security system to an armed mode after the departure of the person who used the restricted credentials. Similarly, the user may indicate that the security system should not change to the armed mode, for example, because they expect to be arriving soon and would rather not have to disarm the security system on their arrival.

When the occupancy estimate indicates that the person who used the restricted credentials is still present in the environment, the hub computing device may notify an appropriate party, for example, a user of the security system such as the a resident of a home. The notification may be sent to a personal computing device associated with the user, such as a smartphone. The notification may indicate that a person who used the restricted credentials to disarm the security system is still present after the expiration of the restricted credentials, and the security system has not been re-armed. The notification may ask if the user of the security system wishes to extend the validity of the restricted credentials by any suitable amount of time. If the user chooses to extend the validity of the restricted credentials, the hub computing device may again monitor for the expiration the restricted credentials based on the new expiration condition set by the time added to the validity of the restricted credentials. Otherwise, the user may choose to not extend the validity of the restricted credentials, and may initiate communication with the person who used the restricted credentials in any suitable manner, for example, through a voice call, text message, or other use of contact data associated with the restricted credentials, or through use of speakers, microphones, and screens that are part of the smart home environment. The user may, for example, communicate with the person who used the restricted credentials to ascertain why they are still present after the expiration of the restricted credentials, and to determine any appropriate actions to take.

The presence of an unauthorized person who is not the person who used the restricted credentials in the environment after the restricted credentials have expired may be handled in any suitable manner. For example, the hub computing device may automatically re-arm the security system, may notify a user of the security system so that they may choose to re-arm the security system if it was not automatically re-armed or attempt to communicate with the unauthorized person, or may issue an alert, alarm, or notification to an appropriate authority.

When the hub computing device has determined that restricted credentials are about to expire, the hub computing device may notify the person who used the restricted credentials in any suitable manner. For example, the hub computing device may send a message via email, SMS, MMS, or application notification, to a computing device, such as a smartphone, tablet, laptop, or wearable computing device, associated with the person who used the restricted credentials to disarm the security system as indicated by the contact data associated with the restricted credentials. The hub computing device may display a message, for example, on a display of the hub computing device or other display that is part of the smart home environment, such as a television or display on a smart thermostat, or may use, for example, a speaker and microphone system to audibly communicate with the person who used the restricted credentials.

In some implementations, a machine learning system may be used to set the validity and expiration conditions for restricted credentials. The machine learning system may be, for example, a Bayesian network, artificial neural network, support vector machine, or any other suitable statistical or heuristic machine learning system type. The machines learning system may be trained through the usage of issued restricted credentials. For example, a particular person who uses restricted credentials may repeatedly leave 3 hours before their restricted credentials expire. The machine learning system may adjust the expiration condition of the restricted credentials so that they expire earlier. A particular person who uses restricted credentials may have credentials which are valid from 9:00 am to 5:00 pm, but may repeatedly arrive around 10 am. The machine learning system may adjust the restricted credentials so that they are usable starting from a later time, for example, 9:45 am. A particular person who uses restricted credentials may repeatedly stay beyond the expiration of the restricted credentials, and a user of the security system may consistently extend the validity of the restricted credentials by 15 minutes whenever this happens. The machine learning system may adjust the expiration condition of the restricted credentials so that they expire later. In this way, the machine learning system may adjust the validity and expiration conditions of restricted credentials based on their usage, to better match the actual schedule of the person using the restricted credentials.

In some implementations, restricted credentials may be used to change the mode of a security system or secured device in any suitable manner. Restricted credentials may arm or disarm a security system, or may change the mode of a security system, arming and disarming various components of the security system, including secured devices. For example, restricted credentials may be issued to allow a person to lock a secured device, such as a safe or a locker which may be connected to a security system. When the restricted credentials are near expiration, a dis-arm reminder may be issued to the person who used the restricted credentials. The dis-arm reminder may indicate to the person that their restricted credentials are near expiration, and that they should di s-arm the security system, or secured device changing it back to a disarmed mode, before the restricted credentials expire. This may allow, for example, a person to use restricted credentials to lock a locker in which they have stored items in a public environment, and the reminder before the restricted credentials expire may help ensure that the person unlocks the locker and retrieves any of their stored items before the restricted credentials expire. Expiration of the restricted credentials may result in the safe or locker automatically unlocking, or the safe or locker may remain locked, but may only be openable with non-restricted credentials.

Figure 13:
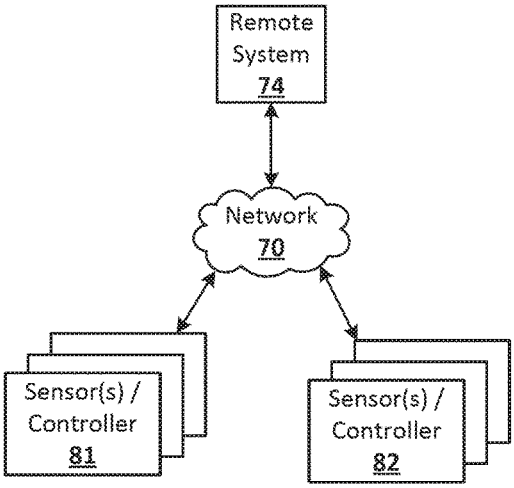
FIG. 13 shows a system according to an embodiment of the disclosed subject matter.

FIG. 1 shows an example system suitable for security system re-arming according to an implementation of the disclosed subject matter. A hub computing device 100 may include a signal receiver 110, an occupancy estimator 120, a mode selector 130, a credentials manager 150, and storage 140. The hub computing device 100 may be any suitable device, such as, for example, a computer 20 as described in FIG. 11, for implementing the signal receiver 110, the occupancy estimator 120, the mode selector 130, and storage 140. The hub computing device 100 may be, for example, a controller 73 as described in FIG. 13. The hub computing device 100 may be a single computing device, or may include multiple connected computing devices, and may be, for example, a smart thermostat, other smart sensor, smartphone, tablet, laptop, desktop, smart television, smart watch, or other computing device that may act as a hub for a smart home environment, which may include a security system and automation functions. The smart home environment may be controlled from the hub computing device 100. The hub computing device 100 may also include a display. The signal receiver 110 may be any suitable combination of hardware or software for receiving signals generated by sensors that may be part of the smart home environment and may be connected to the hub computing device 100. The occupancy estimator 120 may be any suitable combination of hardware and software for generating an occupancy estimate for the environment from the signals generated by the sensors. The mode selector 130 may be any suitable hardware and software for selecting a mode for the security system of the smart home environment. The credentials manager 150 may be any suitable combination of hardware and software for managing credentials, including restricted credentials, used to access the security system and other functions of the smart home environment. The mode 141 may indicate the current the mode of the security system, and may be stored the storage 140 in any suitable manner.

The hub computing device 100 may be any suitable computing device for acting as the hub of a smart home environment. For example, the hub computing device 100 may be a smart thermostat, which may be connected to various sensors throughout an environment as well as to various systems within the environment, such as HVAC systems, or it may be another device within the smart home environment. The hub computing device 100 may include any suitable hardware and software interfaces through which a user may interact with the hub computing device 100. For example, the hub computing device 100 may include a touchscreen display, or may include web-based or app based interface that can be accessed using another computing device, such as a smartphone, tablet, or laptop. The hub computing device 100 may be located within the same environment as the smart home environment it controls, or may be located offsite. An onsite hub computing device 100 may use computation resources from other computing devices throughout the environment or connected remotely, such as, for example, as part of a cloud computing platform. The hub computing device 100 may be used to arm a security system of the smart home environment, using, for example, an interface on the hub computing device 100. The security system may be interacted with by a user in any suitable matter, including through a touch interface or voice interface, and through entry of a PIN, password, or pressing of an "arm" button on the hub computing device 100.

The hub computing device 100 may include a signal receiver 110. The signal receiver 110 may be any suitable combination of hardware and software for receiving signals from sensors connected to the hub computing device 100. For example, the signal receiver 110 may receive signals from any sensors distributed throughout a smart home environment, either individually or as part of sensor devices. The signal receiver 110 may receive any suitable signals from the sensors, including, for example, audio and video signals, signals indicating light levels, signals indicating detection or non-detection of motion, signals whether entryways are open, closed, opening, closing, or experiencing any other form of displacement, signals indicating the current climate conditions within and outside of the environment, smoke and carbon monoxide detection signals, and signals indicating the presence or absence of occupants in the environment based on Bluetooth or WiFi signals and connections from electronic devices associated with occupants or fobs carried by occupants. The signal receiver 110 may pass received signals to other components of the hub computing device 100 for further processing, such as, for example, detection of tripped motion and entryway sensors and use in automation and security determinations, and for storage. The signal receiver 110 may also be able to receive, or to associate with a received signal, an identification for the sensor from which the signal was received. This may allow the signal receiver 110 to distinguish which signals are being received from which sensors throughout the smart home environment. The signal receiver 110 may filter signals based on type of sensor that generated the signal. For example, the signal receiver may send only signals generated by sensors relating to the occupancy of the environment to the occupancy estimator 120.

The hub computing device 100 may include an occupancy estimator 120. The occupancy estimator 120 may be any suitable combination of hardware and software for generating an occupancy estimate for the environment based on the signals from the various sensors. The occupancy estimator 120 may, for example, use any suitable machine learning system to generate an occupancy estimate from the environment based on the signals from the various sensors. The occupancy estimate generated by the occupancy estimator 120 may include an estimate of the number of occupants in the environment, the identity of the occupants, and their locations throughout the environment.

The hub computing device 100 may include a mode selector 130. The mode selector 130 may be any suitable combination of hardware and software for determining an appropriate mode for the security system of the smart home environment, and for changing the mode of the security system based on either on the determined mode or on a mode indicated through input by, for example, a user of the security system or occupant of the environment. The mode selector 130 may determine a mode for the security system based on, for example, the current mode 141 of the security system, an occupancy estimate from the occupancy estimator 120, and an indication of the presence of valid or expired credentials from the credentials manager 150. The mode selector 130 may be able communicate with an occupant of the environment, for example, through output device connected to the hub computing device 100 or through a computing device such as a smartphone, tablet, or wearable device, associated with the occupant. The mode selector 130 may also be able to communicate with a user of the security system, for example, through a computing device such as a smartphone, tablet, or wearable device associated with the user, even when they are not present within the environment.

The credentials manager 150 may be any suitable combination of hardware and software for managing credentials, including restricted credentials, used to access the security system and other functions of the smart home environment. The credentials manager 150 may track the credentials, including restricted credentials, which have been issued to residents or occupants of the environment and guests. The credentials manager 150 may track the association between issued credentials and the individuals or groups to whom the credentials were issued, including, for example, contact data for the individuals or groups. The credentials manager 150 may associate restricted credentials with a schedule that indicates when the restricted credentials are usable, how long they are valid for after being used, and when their expiration conditions are near. The credentials manager 150 may also associate restricted credentials with expiration conditions based on resource usage. The credentials manager 150 may associate restricted credentials with the access granted by the use of the restricted credentials, for example, determining which sensors in the smart home environment are disarmed and which remain armed when the restricted credentials are used. The credentials manager 150 may associate with restricted credentials with a change in the mode of a security system or security device that can be affected through use of the restricted credentials. For example, the restricted credentials may be associated with the ability to open a secured device, such as a safe or locker. The credentials manager 150 may verify credentials when they are input to the hub computing device 100 or other device of the smart home environment, and may cause the mode selector 130 to change the mode of the security system based on the verified credentials. When restricted credentials are entered, the credentials manager 150 may verify that the credentials are usable and valid at the time they are entered, and then may track the expiration condition of the restricted credentials to determine when they are near expiration and when they are expired. The credentials manager 150 may notify the mode selector 130 when restricted credentials are near expiration and are expired.

The storage 140 may be any suitable storage hardware connected to the hub computing device 100, and may store the mode 141 in any suitable manner. For example, the storage 140 may be a component of the hub computing device, such as a flash memory module or solid state disk, or may be connected to the hub computing device 100 through any suitable wired or wireless connection. It may be a local storage, i.e., within the environment within which the hub computing device 100 operates, or it may be partially or entirely operated by a remote service, such as a cloud-based monitoring service as described in further detail herein. The mode 141 may be stored in any suitable manner and format, and may be accessed and updated by the mode selector 130 to determine the current mode of the security system, and to update the mode of the security system when the mode selector 130 selects a new mode.

Figure 2:
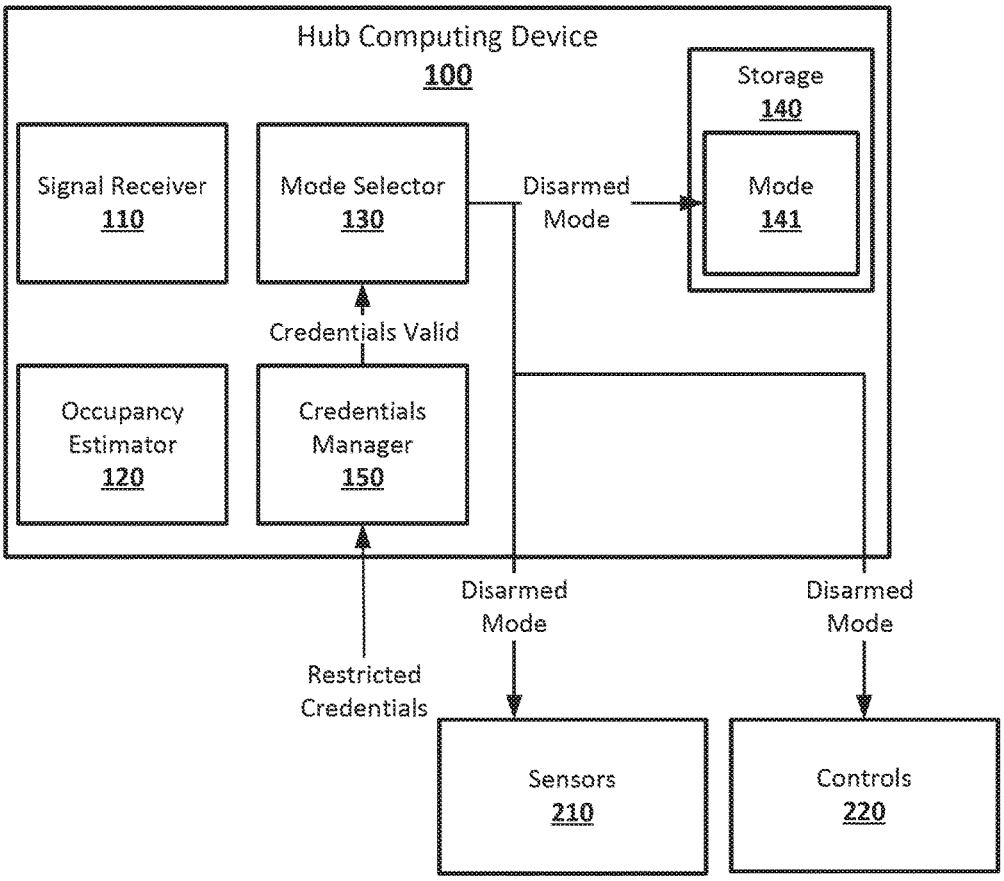
FIG. 2 shows an example arrangement suitable for security system re-arming according to an implementation of the disclosed subject matter.

FIG. 2 shows an example arrangement suitable for security system re-arming according to an implementation of the disclosed subject matter. The hub computing device 100 may be the hub, or controller, for a smart home environment. A person may use restricted credentials to gain access to the environment. The restricted credentials may be entered into the hub computing device 100 as a PIN or passcode, or through biometric input such as a fingerprint or facial or voice recognition, or through use of a fob or identification of a personal computing device through, for example, Bluetooth or Wi-Fi signals. The credentials manager 150 may verify the restricted credentials, for example, determining that the restricted credentials are usable and valid at the time they are entered. For example, restricted credentials which are usable on weekdays between 9:00 am and 5:00 pm and are valid for 3 hours may only be verified by the credentials manager 150 if they are entered on a weekday between 9:00 am and 5:00 pm.

After verifying the restricted credentials, the credentials manager 150 may indicate to the mode selector 130 that the restricted credentials are valid. The indication may also include the access associated with the restricted credentials. The mode selector 130 may change the security system of the smart home environment to a disarmed mode. The disarmed mode may be based on the access associated with the restricted credentials. For example, the mode selector 130 may determine which of sensors 210 to enable and which to disable. The sensors 210 may include any sensor devices, each including multiple any number of sensors, distributed through the smart home environment and connected to the hub computing device. Sensor devices in the sensors 210 may include motion sensors, entryway sensors, light sensors, camera, microphones, sensors for detected Bluetooth and Wi-Fi devices and RFID signals, and any other suitable sensor types. The mode selector 130 may, for example, disarm entryway sensors and motion sensors which monitor entryways and rooms to which the restricted credentials permit access, while keeping sensors armed for rooms to which the restricted credentials do not permit access. The mode selector 130 may also adjust controls 220 of the smart home environment, such as thermostats, light switches, and locks, based on the disarmed mode selected based on the restricted credentials. For example, automated locks on entryways to which the restricted credentials permit access may be unlocked and room light may be turned on. The thermostat may be adjusted to a suitable temperate for the user of the restricted credentials. The mode selector 130 may update the mode 141, stored in the storage 140, to indicate the selected disarmed mode, for example, including which sensors 210 were disarmed and any changes made to any of the controls 220.

Figure 3:
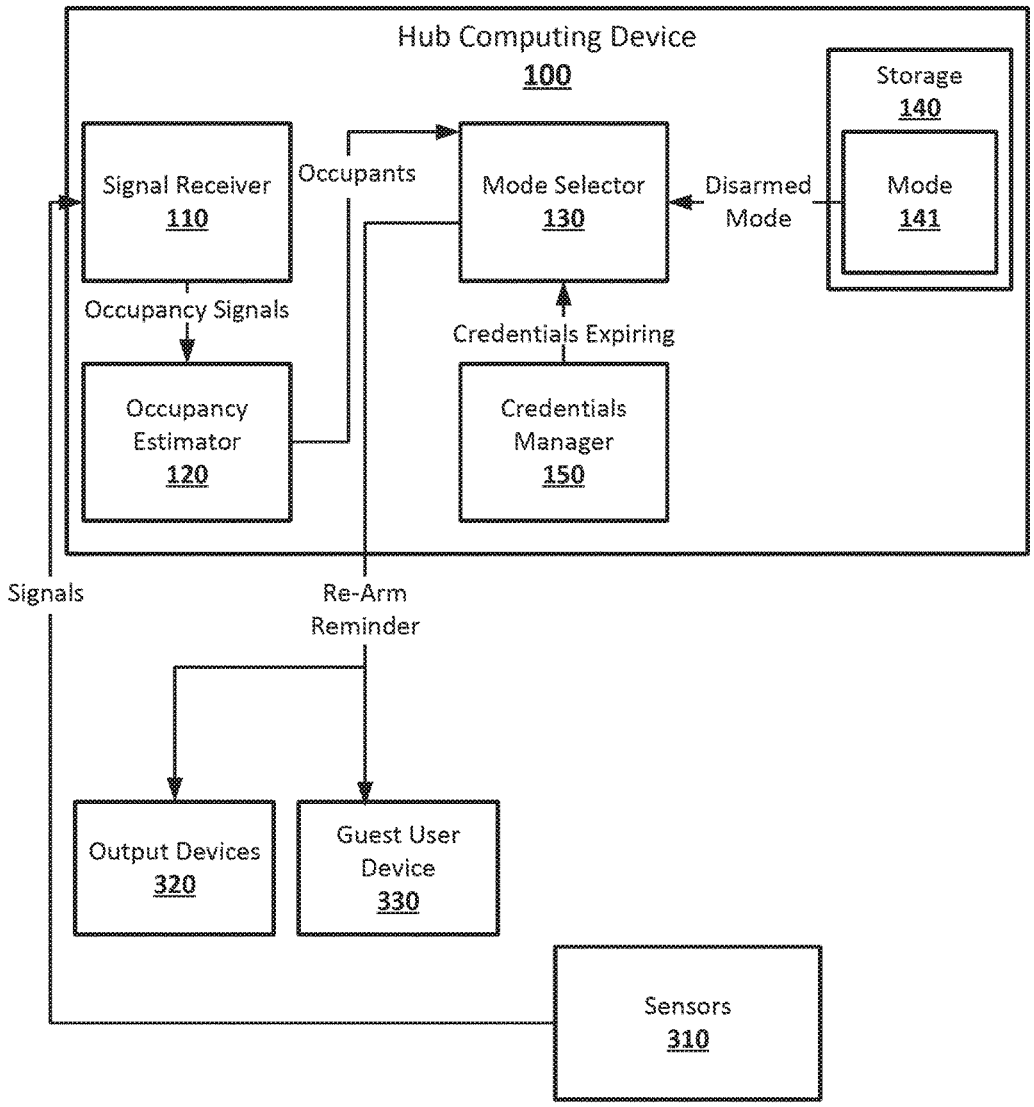
FIG. 3 shows an example arrangement suitable for security system re-arming according to an implementation of the disclosed subject matter.

FIG. 3 shows an example arrangement suitable for security system re-arming according to an implementation of the disclosed subject matter. The credentials manager 150 may monitor the expiration condition the restricted credentials that were used to change the security system of the smart home environment to a disarmed mode. The expiration condition may be the reaching of a specific time, such as 5:00 pm, a specific date and time, or may be the elapsing of some amount of time from when the credentials were used to change the security system to a disarmed mode. When the restricted credentials are near expiration, for example, with some amount of time, or some percentage of the time for which the restricted credentials are valid, remaining before the restricted credentials expire, the credentials manager 150 may notify the mode selector 130. The signal receiver 110 may receive signals from various sensors 210 distributed throughout the environment. The occupancy estimator 120 may receive the signals from the signal receiver 110. The occupancy estimator 120 may receive signals from the sensors 210 and may filter out any signals not related to occupancy of the environment, or may receive the occupancy signals after other signals have been filtered out by, for example, the signal receiver 110. The occupancy estimator 120 may generate an occupancy estimate for the environment. The occupancy estimate may include an indication of the number and identity of occupants in the environment.

Based on the occupancy estimate and the indication that the restricted credentials are near expiration, the mode selector 130 may issue a reminder to re-arm the security system to the person who used the restricted credentials. For example, if the occupancy estimate indicates that the person who used the restricted credentials is still in the environment, the mode selector 130 may issue the re-arm reminder through output devices 320 connected to the hub computing device 100. The output devices 320 may be, for example, speakers or screens distributed throughout the smart home environment. The re-arm reminder may be any suitable combination of audio and video. The output devices 320 used to issue the re-arm reminder may be based on the location within the environment of the person who used the restricted credentials. For example, if the occupancy estimate indicates that the person is located in the living room, only a screen or speakers in the living room may be used to issue the re-arm reminder. The person may be reminded to re-arm the security system using the restricted credentials before they leave, and before the restricted credentials expire. If the occupancy estimate indicates that the person who used the restricted credentials is no longer present in the environment, the re-arm reminder may be issued to a guest user device 330, which may be any suitable computing device associated with the person to whom the restricted credentials were issued. This may prompt the person to return and re-arm the security system before the restricted credentials expire.

Figure 4:
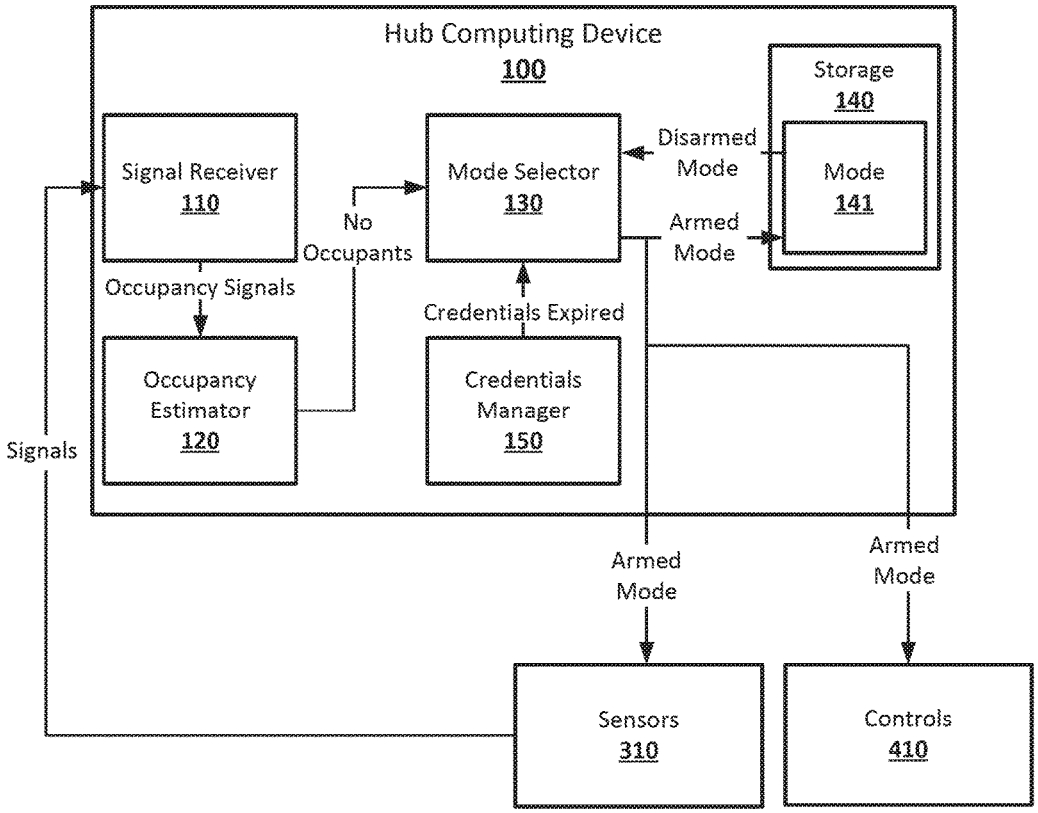
FIG. 4 shows an example arrangement suitable for security system re-arming according to an implementation of the disclosed subject matter.

FIG. 4 shows an example arrangement suitable for security system re-arming according to an implementation of the disclosed subject matter. In some implementations, the mode selector 130 may be permitted to automatically change the security system to an armed mode when restricted credentials that were used to change the security system to a disarmed mode expire and the person who used the restricted credentials is no longer present. The credentials manager 150 may determine that the restricted credentials used to change the security system to a disarmed mode have expired. For example, a specific time, or date and time, may have been reached, or a specified amount of time may have elapsed since the restricted credentials were used to change the security system to a disarmed mode, meeting the expiration condition for the restricted credentials. For example, the credentials manager 150 may determine that 4 hours have passed since restricted credentials with a validity of 4 hours were used to change the security system to a disarmed mode. The credentials manager 150 may indicate to the mode selector 130 that the credentials that were used to change the security system to a disarmed mode have expired.

The mode selector 130 may receive another occupancy estimate from occupancy estimator 120. The occupancy estimate may indicate that no one is present in the environment, including the person who used the restricted credentials that have now expired. The mode selector 130 may check the mode 141 in the storage 140, which may indicate that the security system is in a disarmed mode. This may indicate that the person who used the restricted credentials left without re-arming the security system. The mode selector 130, based on the expiration of the restricted credentials, the absence of the person who used the restricted credentials, and the security system being in a disarmed mode may automatically change the mode of the security system to an armed mode. The mode selector 130 may send any suitable signals to the sensors 210, and to the controls 220, placing the various sensors on the sensor devices and controls into an appropriate state. For example, the mode selector 130 may reverse any changes that were made to the states of any sensors 210 and controls 220 based on the use of the restricted credentials. The mode selector 130 may arm any of the sensors 210 that were disarmed through use of the restricted credentials, may relock any locks that were unlocked, may dim lights that were turned on, may change, for example, lower, the thermostat, and may make any other suitable adjustments to restore the security system to an appropriate armed mode. The mode selector 130 may update the mode 141 to indicate the armed mode of the security system.

In some implementations, the mode selector 130 may change the security system to an armed mode even when the occupancy estimate indicates that there are still occupants in the environment, so long as the occupancy estimate also indicates that the person who used the restricted credentials has left. For example, a delivery driver may use restricted credentials which disarm entryway sensors on the front door of a house and motion sensors inside the front door, and expire 1 minute after being used. The delivery driver may arrive when the security system is in an armed mode, such as an evening mode, but there are occupants in the home. If the delivery driver does not re-arm the security system after their restricted credentials expire the mode selector 130 may automatically re-arm the security system, re-arming the front door sensor and motion sensor, even though the occupancy estimate may indicate the presence of occupants in other areas of the home, so long as the occupancy estimate indicates that the delivery driver has left. Sensors which were disarmed before the use of the restricted credentials by the delivery driver may remain disarmed.

Figure 5:
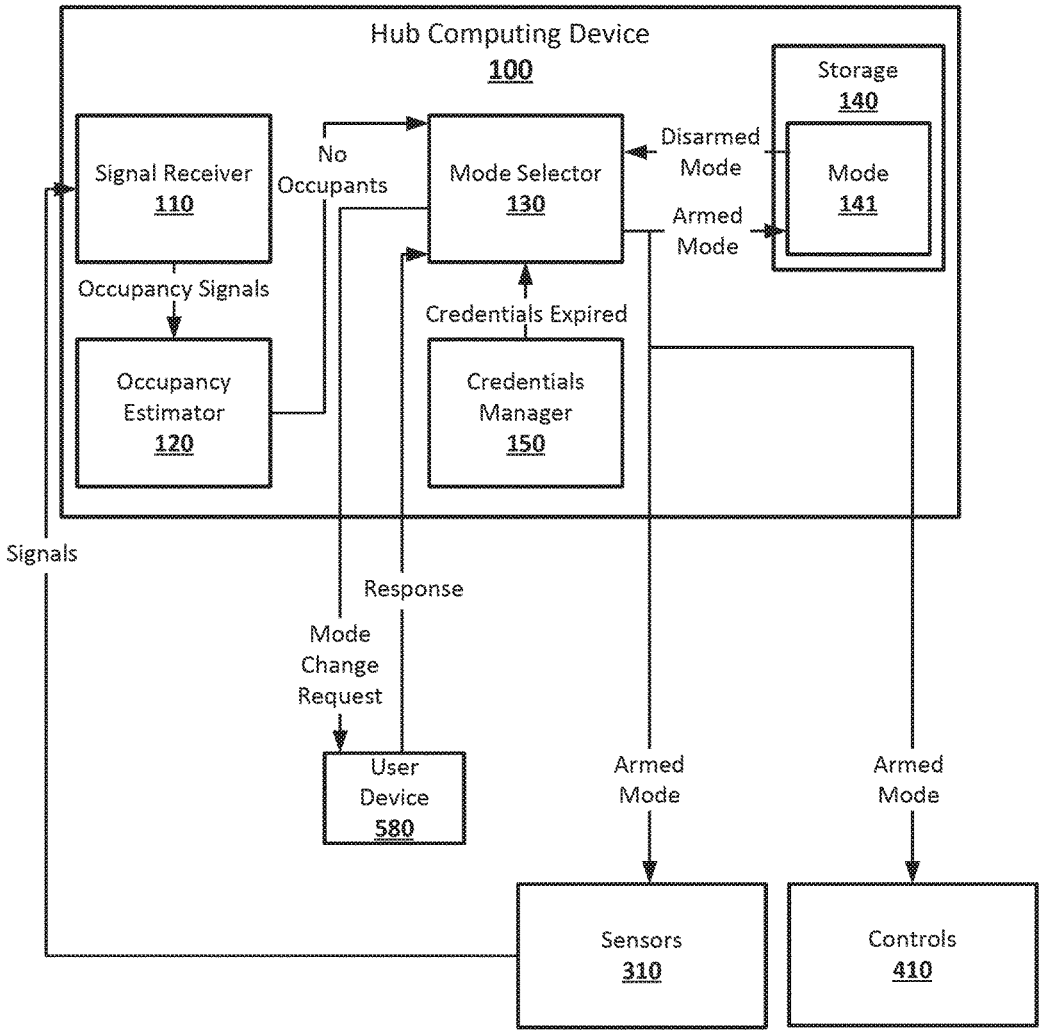
FIG. 5 shows an example arrangement suitable for security system re-arming according to an implementation of the disclosed subject matter.

FIG. 5 shows an example arrangement suitable for security system re-arming according to an implementation of the disclosed subject matter. In some implementations, the mode selector 130 may not be permitted to automatically change the security system to an armed mode when restricted credentials that were used to change the security system to a disarmed mode expire and the person who used the restricted credentials is no longer present. The credentials manager 150 may determine that the restricted credentials used to change the security system to a disarmed mode have expired. The credentials manager 150 may indicate to the mode selector 130 that the credentials that were used to change the security system to a disarmed mode have expired.

The mode selector 130 may receive another occupancy estimate from the occupancy estimator 120. The occupancy estimate may indicate that no one is present in the environment, including the person who used the restricted credentials that have now expired. The mode selector 130 may check the mode 141 in the storage 140, which may indicate that the security system is in a disarmed mode. This may indicate that the person who used the restricted credentials left without re-arming the security system. The mode selector 130, based on the expiration of the restricted credentials, the absence of the person who used the restricted credentials, and the security system being in a disarmed mode, may generate and transmit a mode change request to a user of the security system. For example, the mode change request may be sent to the user computing device 580, which may be a personal computing device such as smartphone, tablet, laptop, or wearable computing device associated with a user of the security system, who may be a resident of the environment. The user may respond to the mode change request by either authorizing the mode change, in which case the mode selector 130 may change the mode of the security system to an armed mode, or denying the mode change request, in which case the mode selector 130 may not change the mode of the security system. If the user authorizes the mode change request, the mode selector 130 may send any suitable signals to the sensors 210, and to the controls 220, placing the various sensors on the sensors devices, and controls into an appropriate state. For example, the mode selector 130 may reverse any changes that were made to the states of any sensors 210 and controls 220 based on the use of the restricted credentials. The mode selector 130 may arm any of the sensors 210 that were disarmed through use of the restricted credentials, may relock and locks that were unlocked, may dim lights that were turned, on, may change, for example, lower the thermostat, and may make any other suitable adjustments to restore the security system to an appropriate armed mode. The mode selector 130 may update the mode 141 to indicate the armed mode of the security system.

Figure 6:
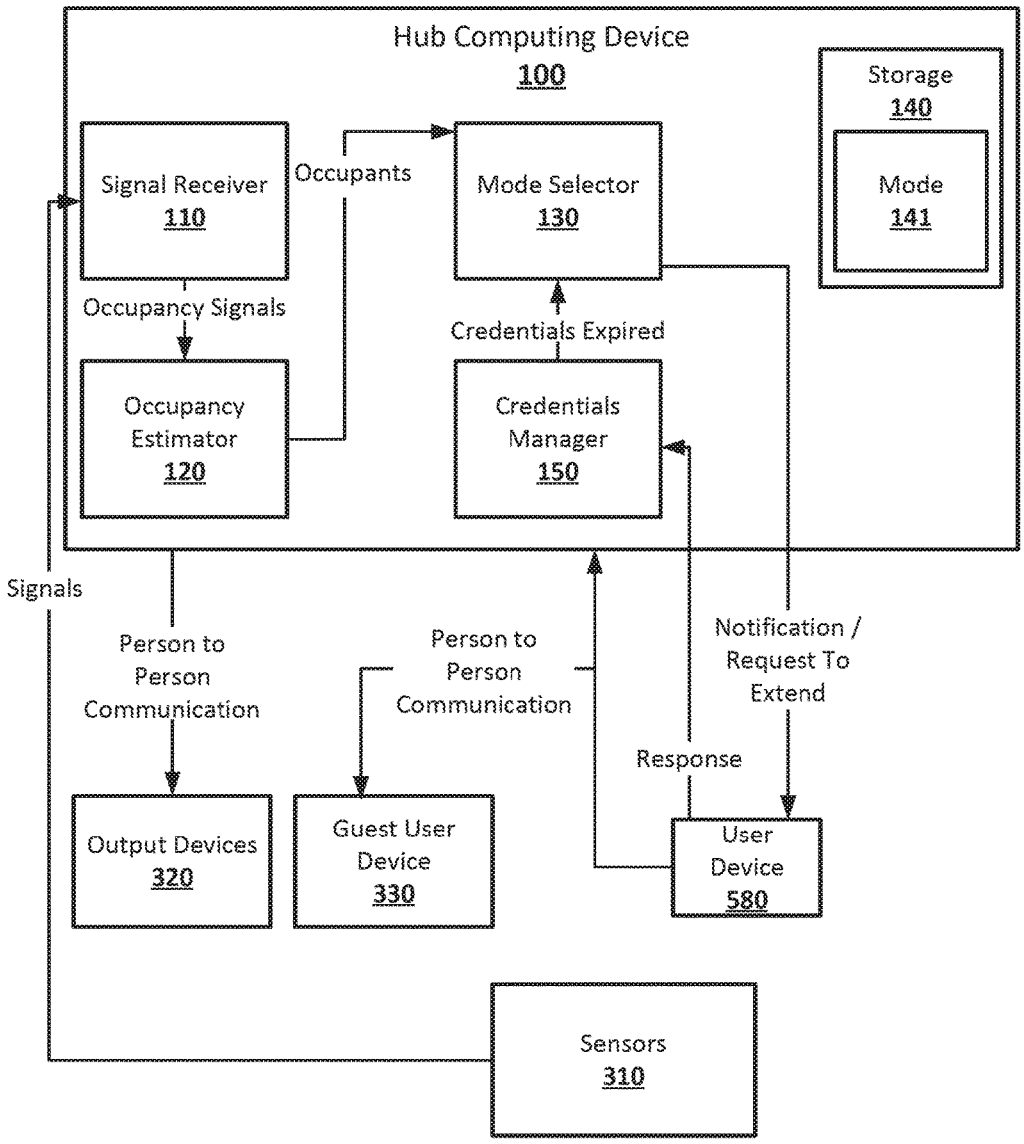
FIG. 6 shows an example arrangement suitable for security system re-arming according to an implementation of the disclosed subject matter.

FIG. 6 shows an example arrangement suitable for security system re-arming according to an implementation of the disclosed subject matter. The credentials manager 150 may determine that the restricted credentials used to change the security system to a disarmed mode have expired. The credentials manager 150 may indicate to the mode selector 130 that the credentials that were used to change the security system to a disarmed mode have expired. The mode selector 130 may receive another occupancy estimate from occupancy estimator 120. The occupancy estimate may indicate that the person who used the restricted credentials that have now expired is still present in the environment, or that some other unauthorized person is present in the environment. The mode selector 130 may generate and transmit a notification of the presence of the person after the expiration of their credentials, and a request to extend the validity of the restricted credentials. The notification and request may be transmitted to, for example, the user device 580 of a user of the security system. The user may choose to grant the request for to extend the validity of the restricted credentials, initiate communication with the person, who may be the person who used the now expired credentials or some other unauthorized person, who is present in the environment, or both.

When the user chooses to grant the request to extend the validity of the restricted credentials, the response may be received by the credentials manager 150. The credentials manager 150 may extend the validity of the now expired restricted credentials, for example, by any suitable amount of time or resource usage. The amount of time or resource usage for which the validity of the restricted credentials are extended may be some default amount of time or resource usage, or may be some amount of time or resource usage specified in any suitable manner by the user of the user device 580. The additional time, or resource usage, may temporarily change the expiration conditions for the restricted credentials, and the credentials manager 150 may indicate to the mode selector 130 that the restricted credentials are no longer expired, and may begin to monitor for the occurrence of the new expiration condition. For example, the user of the user device 580 may extend expired restricted credentials by 5 minutes, starting from when the credentials manager 150 receives the user's decision to grant the request for additional time. The restricted credentials may then become valid for 5 additional minutes. After the additional 5 minutes elapse, the credentials manager 150 may again indicate to the mode selector 130 that the restricted credentials have expired. If the restricted credentials are reusable, the additional time may not be added to the future validity of the restricted credentials. For example, restricted credentials which expire at 5:00 pm every weekday may still expire at 5:00 pm on Wednesday, and every other subsequent weekday, even if they were extended to 5:05 pm on the preceding Tuesday. When the user chooses not to grant the request to extend the validity of the restricted credentials, the restricted credentials may remain expired until they become usable and valid again based on any schedule associated with the restricted credentials. Restricted credentials meant for one-time use may not become valid or usable again.

The user may, using the user device 580, initiate person-to-person communication with the person who is present in the environment. For example, the user device 580 may be a smartphone, and the user may call, or send an SMS, MMS, other messaging service message, or email, to the person who used the restricted credentials. The notification and request to extend the validity of the restricted credentials received at the user device 580 may include contact data for the person, for example, contact data such as a phone number, email address, or messaging service handle, that was associated with the person to whom the restricted credentials were issued and who is assumed to be the person who used the restricted credentials and is present in the environment. The user may also use the user device 580 to initiate person-to-person communication through the hub computing device 100 and output devices 320 of the smart home environment. For example, the user device 580 may be connected to a speaker and microphone within the environment which may be used to communicate with the person who is present in the environment. This may allow the user to communicate with a person present in the environment who either does not answer direct attempts at communication, for example, not answering their phone, or a person who is unauthorized and for whom the user does not have any contact data. The person-to-person communication may allow the user to ascertain the reason for the presence of the person in the environment after the restricted credentials have expired, and determine what actions, if any, to take.

Figure 7:
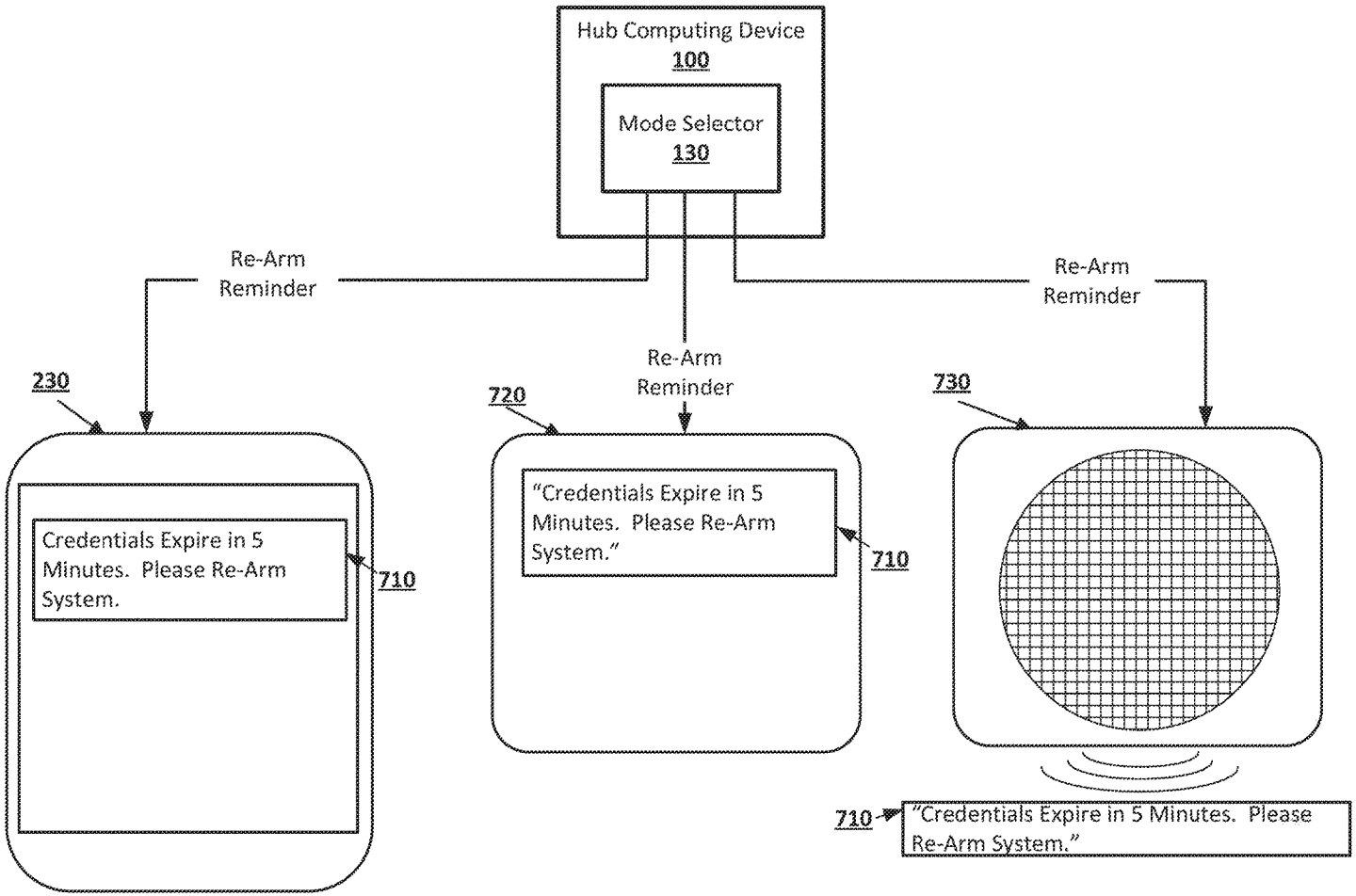
FIG. 7 shows an example arrangement suitable for security system re-arming according to an implementation of the disclosed subject matter.

FIG. 7 shows an example arrangement suitable for security system re-arming according to an implementation of the disclosed subject matter. The mode selector 130 may issue a re-arm reminder to a person who used restricted credentials which are about to expire in any suitable manner. For example, a re-arm reminder may be sent to the display of the guest user device 330, a display 720 of the hub computing device 100 or other computing device within the smart home environment, or to a speaker 730 within the smart home environment. The re-arm reminder may be sent any number of displays or speakers, which may be chosen, for example, based on their proximity to the person within the environment. For example, if the person is currently near the speaker 730, for example, according to an occupancy estimate, the speaker 730 may be used to communicate the re-arm reminder to the person. The re-arm reminder may be sent to the guest user device 330, which may be, for example, the person's smartphone. This may allow the person to receive the re-arm reminder even if they aren't near any of the output devices 320, for example, if they have just left the environment. The re-arm reminder may include, for example, a request 710, which may explain in written form or verbally how near to expiration the restricted credentials used by the person are, and include a request that the person re-arm the security system before the restricted credentials expire and they are no longer able to re-arm the security system themselves.

Figure 8:
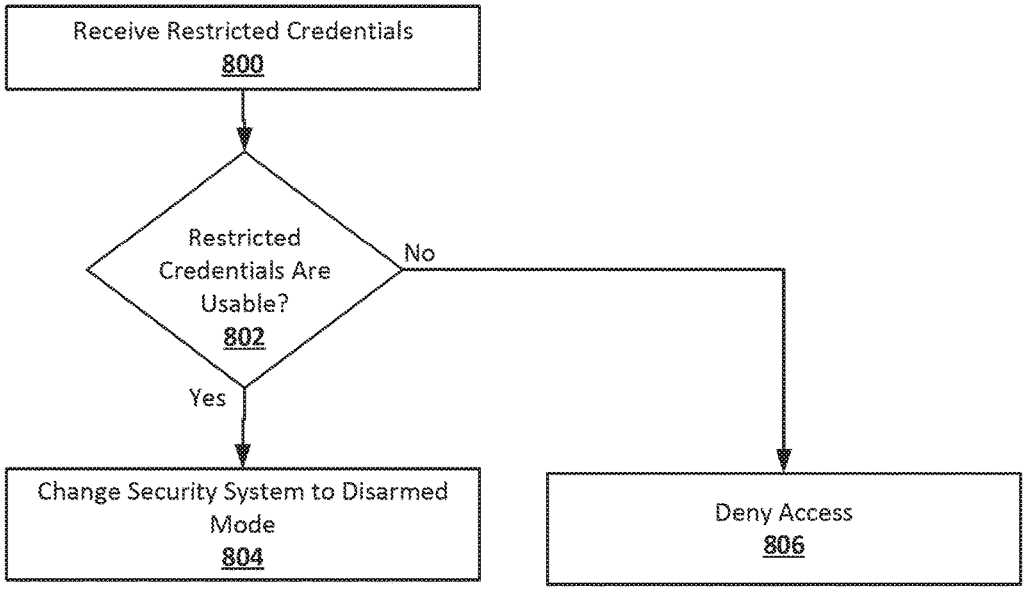
FIG. 8 shows an example of a process suitable for security system re-arming according to an implementation of the disclosed subject matter.

FIG. 8 shows an example of a process suitable for security system re-arming according to an implementation of the disclosed subject matter. At 800, restricted credentials may be received. For example, a person may enter restricted credentials into the hub computing device 100, or other device of a smart home environment, in the form of a PIN, passcode, biometric input, or through use of a fob or identification of a personal computing device through, for example, Bluetooth or Wi-Fi signals.

At 802, whether the restricted credentials are usable may be determined. For example, the credentials manager 150 may check a schedule associated with the restricted credentials against the day, date, and time, the restricted credentials were entered into the hub computing device 100 to determine if the restricted credentials can be used to disarm the security system of the smart home environment. Restricted credentials may be usable when they are entered into the hub computing device 100 during a period of usability specified by the schedule associated with the restricted credentials, and when any other usability conditions associated with the restricted credentials, such as not already having been using some number of time already since the start of the day, are fulfilled. For example, restricted credentials which may be used once per day, and are usable from 9:00 am to 5:00 pm, may be determined to be usable if they are entered into the hub computing device at 11:00 am, and that is the first time they have been used that day. If the restricted credentials are determined to be usable, flow may proceed to 804. Otherwise, flow may proceed to 806.

At 804, the security system may be changed to a disarmed mode. For example, usable restricted credentials may have been entered into the hub computing device 100. The credentials manager 150 may indicate to the mode selector 130 that the security system should be changed to a disarmed mode. The restricted credentials may be associated with a specific disarmed mode for the security system, which may indicate which sensors 210 within the smart home environment should be disarmed and which should remain armed, and which controls 220, such as locks, thermostats, and lights, should be adjusted, and which should remain in their current state. The mode selector 130 may send signals to the sensors 210 and controls 220 to change them to an appropriate state for the disarmed mode associated with the restricted credentials. This may permit the person who used the restricted credentials appropriate access to the environment, for example, to specific rooms or areas, while still preventing access to parts of the environment the person should not have access to. The mode 141 in the storage 140 may be updated to reflect the disarmed mode of the security system. The credentials manager 150 may being monitoring for the occurrence of the expiration condition of the restricted credentials.

At 806, access may be denied. For example, if the credentials manager 150 determines that the restricted credentials entered into the hub computing device 100 are not usable, access to the environment may be denied. The mode of the security system may not be changed. For example, a person may attempt to use restricted credentials that are usable only on weekdays on a weekend. Though the restricted credentials may still be valid and usable on weekdays, any attempt to use them on weekends will result in denial of access to the environment.

Figure 9:
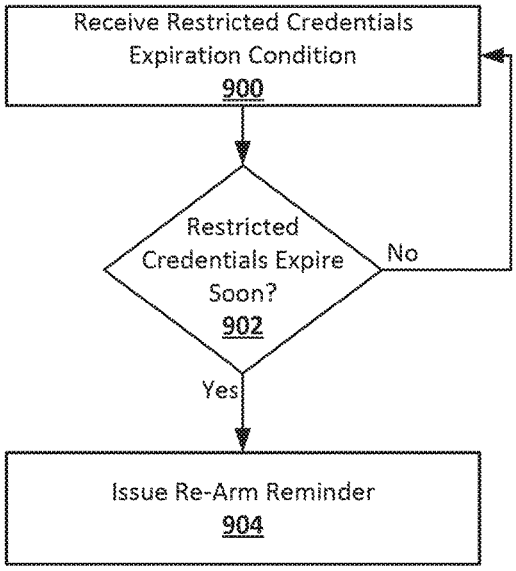
FIG. 9 shows an example of a process suitable for security system re-arming according to an implementation of the disclosed subject matter.

FIG. 9 shows an example of a process suitable for security system re-arming according to an implementation of the disclosed subject matter. At 900, an expiration condition for restricted credentials may be received. For example, the credentials manager 150 may receive an expiration condition associated with restricted credentials that have been used to change the security system to a disarmed mode. The expiration condition may be received from, for example, the storage 140, or may be stored separately from the hub computing device 100, for example, in cloud storage.

At 902, whether the restricted credentials expire soon may be determined. For example, the credentials manager 150 may evaluate the received expiration condition, and determine if the expiration condition will be met in the near future, for example, within some threshold amount of time which may be a set amount of time, or may be based on the total amount of time for which the restricted credentials are valid. For example, the credentials manager 150 may determine that restricted credentials expire soon when 95% of the time for which the restricted credentials are valid has elapsed, for example, after 3 hours and 38 minutes for credentials which are valid for four hours. The percentage may be adjusted based on the amount of time for which restricted credentials are valid so that restricted credentials that are valid for short periods of time are considered to be expiring soon after a smaller percentage of the time for which the restricted credentials are valid as elapsed. For example, restricted credentials which are valid for 1 minute may be determined to be expiring soon after half of the time period of their validity has elapsed. Credentials which expire at a given time, rather than based on elapsed time, may be considered to be expiring soon when they reach some threshold amount of time from the given time at which they expire. For example, restricted credentials which expire at 5:00 pm may be determined to be expiring soon at 4:55 pm. If the restricted credentials expire soon, flow may proceed to 904. Otherwise, flow may proceed back to 900, as, for example, the credentials manager 150 continues to monitor the expiration condition for the restricted credentials.

At 904, a re-arm reminder may be issued. For example, the person who used the restricted credentials may be issued a re-arm reminder through the output devices 320 or the guest user device 330. The re-arm reminder may indicate how soon the restricted credentials will expire, and notify the person that they should re-arm the security system before the restricted credentials expire and can no longer bused to re-arm the security system. The re-arm reminder may include any suitable audio or visual components, and may, for example, include instructions on how to re-arm the security system. The re-arm reminder may also display, on a screen of the output devices 320 or the guest user device 330, an interface through which the person may use the restricted credentials to re-arm the security system.

Figure 10:
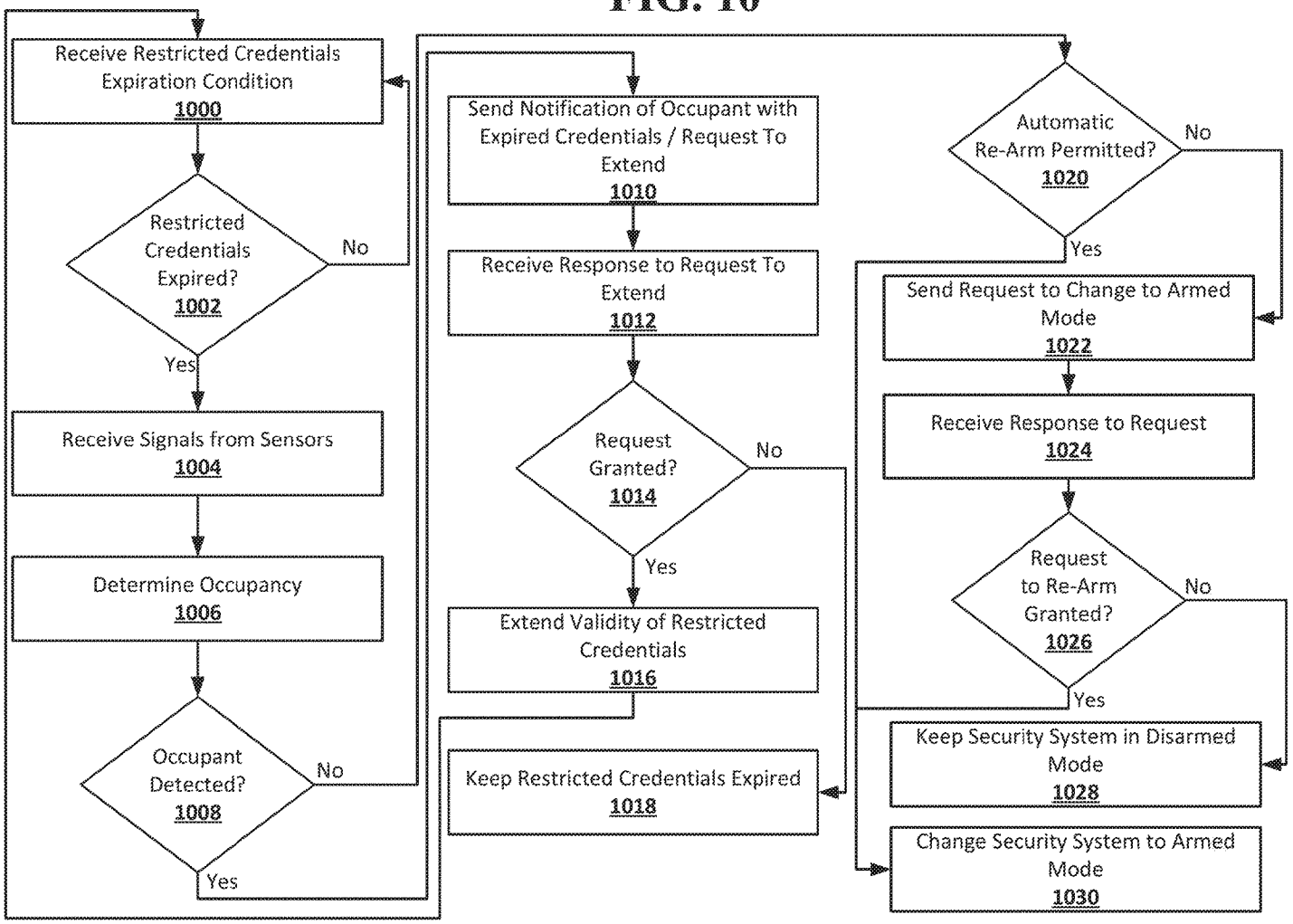
FIG. 10 shows an example of a process suitable for security system re-arming according to an implementation of the disclosed subject matter.

FIG. 10 shows an example of a process suitable for security system re-arming according to an implementation of the disclosed subject matter. At 1000, an expiration condition for restricted credentials may be received. For example, the credentials manager 150 may receive an expiration condition associated with restricted credentials that have been used to change the security system to a disarmed mode. The expiration condition may be received from, for example, the storage 140, or may be stored separately from the hub computing device 100, for example, in cloud storage.

At 1002, whether the restricted credentials are expired may be determined. For example, the credentials manager 150 may evaluate the received expiration condition, and determine if the expiration condition has been met. For example, when the expiration condition is the occurrence of a specific time, the credentials manager 150 may determine that the restricted credentials have expired when that specific time has been reached. The expiration condition may include a specific day or date in addition to a specific time, and the credentials manager 150 may determine that the restricted credentials have expired when the specific day or date has been reached in addition to the specified time. The expiration condition may also be the elapsing of some amount of time from when the restricted credentials are used to change the security system to a disarmed mode, or some amount of resource usage. The credentials manager 150 may determine that the restricted credentials are expired when the specified amount of time has elapsed since the restricted credentials were used. For example, restricted credentials which are valid for 10 minutes after being used may be used at 1:00 pm, and may be determined to be expired at 1:10 pm. If the restricted credentials are determined to be expired, flow may proceed to 1004. Otherwise, flow may proceed back to 1000, as, for example, the credentials manager 150 continues to monitor the expiration condition for the restricted credentials.

At 1004, signals may be received from sensors. For example, the signal receiver 110 of the hub computing device 100 may receive signals from the sensors 210, including sensors such as the motion sensors, cameras, microphones, entryway sensors, mobile device scanners, light sensors, smoke detectors, carbon monoxide detectors, and any other sensors that are connected to the smart home environment.

At 1006, the occupancy of the environment may be determined. For example, the signals received by the signal receiver 110 may be filtered, by the signal receiver 110, or the occupancy estimator 120, to obtain the signals which may be relevant to estimating the occupancy of the environment. For example, signals regarding smoke and carbon monoxide detection may be filtered out, as they may not be useful in determining if occupants are present or absent from the environment. The occupancy estimator 120 may use the remaining signals, which may be occupancy signals, to generate an occupancy estimate for the environment. The occupancy estimate may include indications of, for example, the number and identity of occupants in the environment, whether the occupants are residents, known guests, or unknown, the number of pets in the environment, the location of occupants and pets within the environment, whether any occupants have recently entered or exited the environment, whether any occupants are expected to enter or exit the environment in the near future, the length of time an occupant who is a resident has been present in or absent from the environment, and any other suitable information regarding the occupancy of the environment.

At 1008, whether an occupant is detected may be determined. For example, the occupancy estimate may indicate that no occupants, or no occupants who are either the person who used the restricted credentials or are unauthorized occupants, are detected in the environment. Flow may then proceed to 1020. Otherwise, if the occupancy estimate indicates that an occupant who is either the person who used the restricted credentials or an unauthorized occupant is detected, flow may proceed to 1010.

At 1010, a notification of an occupant present with expired restricted credentials and a request to extend the validity of the restricted credentials may be sent. For example, a notification indicating that the restricted credentials used to change the security system to a disarmed mode have expired and that an occupant who is either the person who used the restricted credentials, or some other unauthorized occupant, has been detected in the environment, may be sent to a user of the security system. The notification may be sent, for example, from the mode selector 130 of the hub computing device 100 to the user device 580. The notification may include the identity of the detected occupant or occupants, if known, along with any known contact data for the detected occupants. Along with the notification, a request to extend the validity of the restricted credentials by some amount of time or resource usage may also be sent. The request may, when displayed on the user device 580, include an interface through which the user may respond to the request, and may allow the user to specify the amount of time or resource usage by which the validity of the restricted credentials should be extended.

At 1012, a response to the request may be received. For example, the hub computing device 100, and mode selector 130, may receive a response to the request to extend the validity of the expired restricted credentials from the user device 580.

At 1014, whether the request was granted may be determined. If the request to extend the validity of the expired restricted credentials was granted, flow may proceed to 1016. Otherwise flow may proceed to 1018.

At 1016, the validity of the restricted credentials may be extended. For example, the credentials manager 150 may temporarily change the expiration condition for the restricted credentials based on the amount additional time or resources usage in the granted request, for example, as specified by the user with the user device 580. For example, the expiration condition may be changed to add a specified amount of time to the validity of the restricted credentials, or to extend the validity of the restricted credentials to some future time. The restricted credentials may be un-expired, and flow may proceed back to 1000, where the credentials manager 150 may monitor for the occurrence of the new expiration condition for the restricted credentials. The extension of the validity of the restricted credentials may be temporary, and may not affect the expiration condition of the restricted credentials if they are used again in the future.

At 1018, the restricted credentials may be kept expired. For example, the user may have denied the request to extend the validity of the restricted credentials. The credentials manager 150 may keep the restricted credentials expired, and may not extend their validity. The user may take any action they deem appropriate, for example initiating person-to-person communication with the detected occupant through the user device 580 and the output devices 320 or guest user devices 330 to ascertain why the person is present in the environment with the disarmed security system after the expiration of the restricted credentials.

At 1020, whether automatic re-arming of the security system is permitted may be determined. For example, the mode selector 130 may check any suitable settings, which may be stored, for example, in the storage 140 or in any other suitable location, to determine whether the mode selector 130 is permitted to automatically re-arm the security system when restricted credentials that were used to change the security system to a disarmed mode have expired. If the mode selector 130 is permitted to automatically re-arm the security system, flow may proceed to 1030. Otherwise, flow may proceed to 1022.

At 1022, a request to change the security system to an armed mode may be sent. For example, the mode selector 130 may not be permitted to automatically re-arm the security system, and may require permission from a user of the security system. A request to change the security system to an armed mode, re-arming the security system, may be sent to a user of the security system. The request to change to an armed mode may be sent in any suitable manner, to any suitable device accessible to the user, such as, for example, the user device 580. The request to change the security system to an armed mode may cause the display of an interface through which the user, with the user device 580, may choose to grant or deny the request.

At 1024, a response to the request may be received. The response, which may be sent by the user using, for example, the user computing device 580, may indicate whether the user has chosen to grant or deny the request to change the security system to an armed mode. The response may be received by, for example, the mode selector 130.

At 1026, whether the response grants the request to re-arm the security may be received. For example, the mode selector 130 may determine whether the user, in their response, has granted the request to change the security system to an armed mode, permitting the mode selector 130 to change the mode of the security system, or the or denied the request, preventing the mode selector 130 from changing the mode of the security system. If the request was granted, flow may proceed to 1030, where the mode may be changed by, for example, the mode selector 1030. Otherwise, flow may proceed 1028.

At 1028, the security system may be kept in a disarmed mode. For example, the user may have chosen not to grant the request to change the security system to an armed mode, preventing the mode selector 130 from changing the mode of the security system. The security system may be kept in the disarmed mode to which the security system was changed when the restricted credentials were used.

At 1030, the security system may be changed to an armed mode. For example, the user may have chosen to grant the request to change the security system to an armed mode, or the mode selector 130 may be permitted to automatically change the security system to an armed mode. The mode selector 130 may change the mode of the security system of the smart home environment to an armed mode. Changing the mode of the security system may include, for example, sending signals to the sensors 210 and controls 220 to set them to appropriate states for the armed mode the security system is being changed to. For example, the sensors 210 which were disarmed when the restricted credentials were used may be re-armed. The controls 220 which had their states changed when the restricted credentials were used may be reverted to their initial states. For example, locks which were unlocked may be relocked, thermostats which were raised may be lowered, and lights which were turned on may be turned back off.

Embodiments disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. In some cases, a sensor may operate as multiple sensor types sequentially or concurrently, such as where a temperature sensor is used to detect a change in temperature, as well as the presence of a person or animal.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

Figure 11:
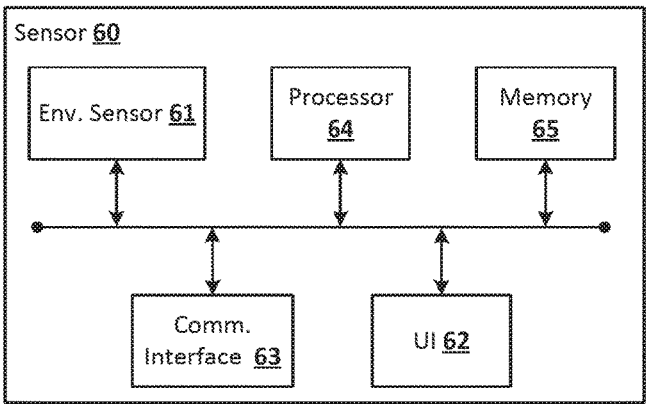
FIG. 11 shows a computing device according to an embodiment of the disclosed subject matter.

A sensor may include hardware in addition to the specific physical sensor that obtains information about the environment. FIG. 11 shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like may allow for communication by the sensor 60 with other devices. A user interface (UI) 62 may provide information and/or receive input from a user of the sensor. The UI 62 may include, for example, a speaker to output an audible alarm when an event is detected by the sensor 60. Alternatively, or in addition, the UI 62 may include a light to be activated when an event is detected by the sensor 60. The user interface may be relatively minimal, such as a limited-output display, or it may be a full-featured interface such as a touchscreen. Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Sensors as disclosed herein may operate within a communication network, such as a conventional wireless network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network, that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 12:
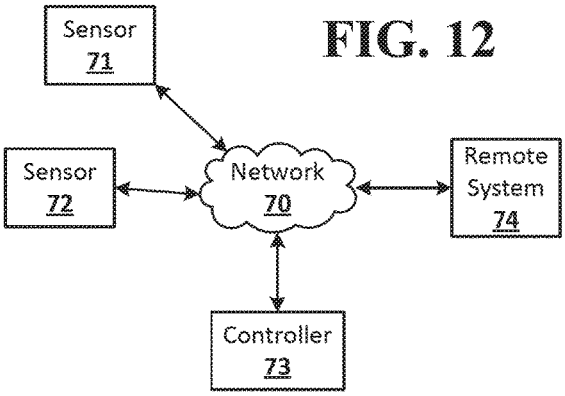
FIG. 12 shows a system according to an embodiment of the disclosed subject matter.

FIG. 12 shows an example of a sensor network as disclosed herein, which may be implemented over any suitable wired and/or wireless communication networks. One or more sensors 71, 72 may communicate via a local network 70, such as a Wi-Fi or other suitable network, with each other and/or with a controller 73. The controller may be a general- or special-purpose computer. The controller may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors may communicate directly with a remote system 74. The remote system 74 may, for example, aggregate data from multiple locations, provide instruction, software updates, and/or aggregated data to a controller 73 and/or sensors 71, 72.

For example, the hub computing device 100 may be an example of a controller 73 and the sensors 210 may be examples of sensors 71 and 72, as shown and described in further detail with respect to FIGS. 1-10.

The devices of the security system and smart-home environment of the disclosed subject matter may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail so as to prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., so as to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The sensor network shown in FIG. 12 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 12 may include a plurality of devices, including intelligent, multi-sensing, network-connected devices that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 12.

According to embodiments of the disclosed subject matter, the smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 12, and the controller 73 may control the HVAC system (not shown) of the structure.

A smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 12, and the controller 73 may control an alarm system to provide a visual and/or audible alarm to the user of the smart-home environment.

A smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 12 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be the sensors 71, 72 shown in FIG. 12. The smart wall switches may detect ambient lighting conditions, and control a power and/or dim state of one or more lights. For example, the sensors 71, 72, may detect the ambient lighting conditions, and the controller 73 may control the power to one or more lights (not shown) in the smart-home environment. The smart wall switches may also control a power state or speed of a fan, such as a ceiling fan. For example, sensors 72, 72 may detect the power and/or speed of a fan, and the controller 73 may adjusting the power and/or speed of the fan, accordingly. The smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, the smart-home environment may include one or more intelligent, multi-sensing, network-connected entry detectors (e.g., "smart entry detectors"). The sensors 71, 72 shown in FIG. 12 may be the smart entry detectors. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed.

The smart-home environment of the sensor network shown in FIG. 12 can include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of the smart-home environment (e.g., as illustrated as sensors 71, 72 of FIG. 12 can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment "learns" who is a user (e.g., an authorized user) and permits the electronic devices associated with those individuals to control the network-connected smart devices of the smart-home environment (e.g., devices communicatively coupled to the network 70). Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

The smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event, any of the network-connected smart devices, such as smart wall plugs located outdoors, detect movement at night time, the controller 73 and/or remote system 74 can activate the outdoor lighting system and/or other lights in the smart-home environment.

In some configurations, a remote system 74 may aggregate data from multiple locations, such as multiple buildings, multi-resident buildings, individual residences within a neighborhood, multiple neighborhoods, and the like. In general, multiple sensor/controller systems 81, 82 as previously described with respect to FIG. 13 may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. Thus, the user may have control over how information is collected about the user and used by a system as disclosed herein.

Figure 14:
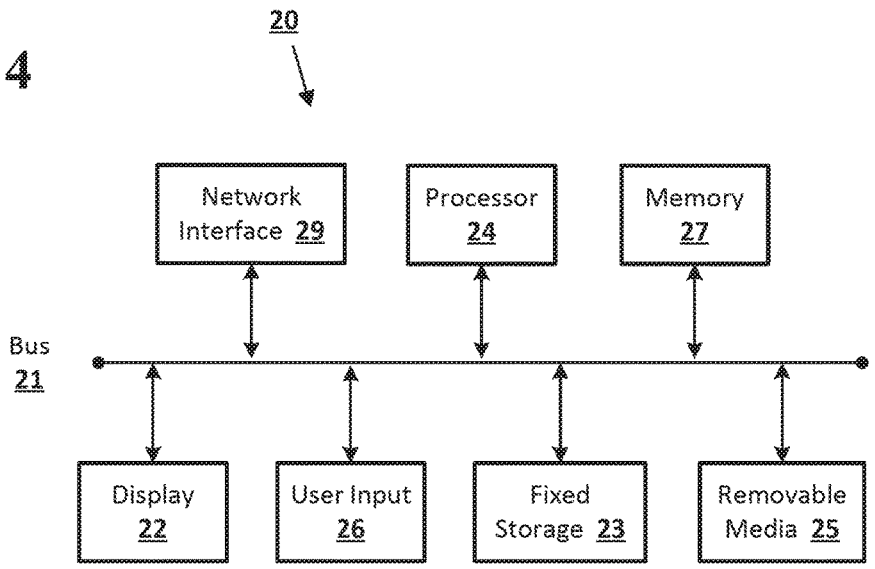
FIG. 14 shows a computer according to an embodiment of the disclosed subject matter.

Embodiments of the presently disclosed subject matter may be implemented in and used with a variety of computing devices. FIG. 14 is an example computing device 20 suitable for implementing embodiments of the presently disclosed subject matter. For example, the device 20 may be used to implement a controller, a device including sensors as disclosed herein, or the like. Alternatively or in addition, the device 20 may be, for example, a desktop or laptop computer, or a mobile computing device such as a smart phone, tablet, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen, a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide such connection using any suitable technique and protocol as will be readily understood by one of skill in the art, including digital cellular telephone, WiFi, Bluetooth®, near-field, and the like. For example, the network interface 29 may allow the device to communicate with other computers via one or more local, wide-area, or other communication networks, as described in further detail herein.

Figure 15:
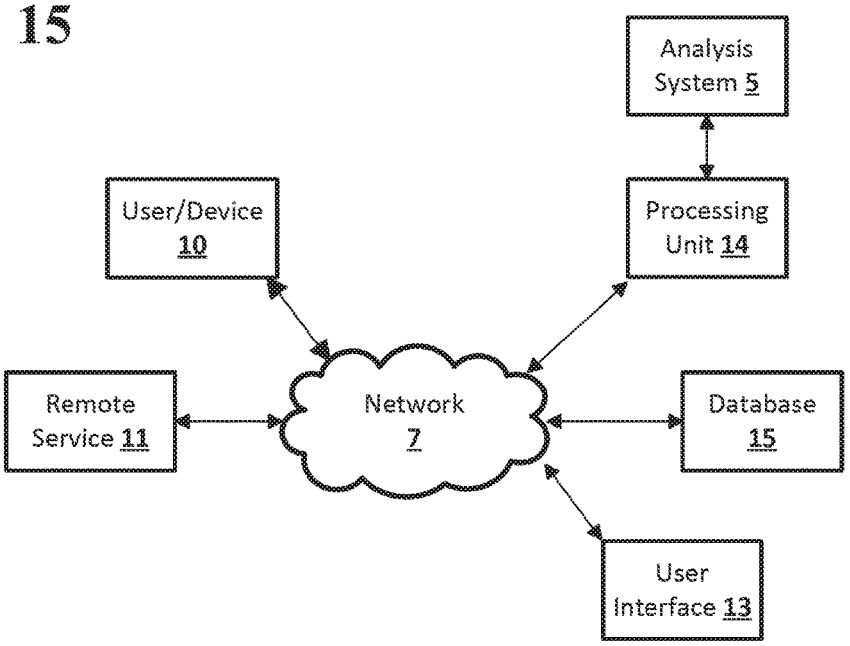
FIG. 15 shows a network configuration according to an embodiment of the disclosed subject matter.

FIG. 15 shows an example network arrangement according to an embodiment of the disclosed subject matter. One or more devices 10, 11, such as local computers, smart phones, tablet computing devices, and the like may connect to other devices via one or more networks 7. Each device may be a computing device as previously described. The network may be a local network, wide-area network, the Internet, or any other suitable communication network or networks, and may be implemented on any suitable platform including wired and/or wireless networks. The devices may communicate with one or more remote devices, such as servers 13 and/or databases 15. The remote devices may be directly accessible by the devices 10, 11, or one or more other devices may provide intermediary access such as where a server 13 provides access to resources stored in a database 15. The devices 10, 11 also may access remote platforms 17 or services provided by remote platforms 17 such as cloud computing arrangements and services. The remote platform 17 may include one or more servers 13 and/or databases 15.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodi ments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A computer-implemented method performed by a data processing apparatus, the method comprising:

determining that restricted credentials used to change a security system of an environment from a first mode to a second mode are expired based on an expiration condition of the restricted credentials;

determining that the security system is in the second mode that the security system was changed to based on the restricted credentials;

receiving one or more signals from one or more sensors distributed in the environment; and generating an occupancy estimate for the environment based on the one or more signals from the one or more sensors in response to determining that the restricted credentials are expired and the security system is in the second mode.

2. The computer-implemented method of claim 1, wherein the expiration condition indicates an amount of time for which the restricted credentials are valid after the restricted credentials are used to change the security system to the second mode.

3. The computer-implemented method of claim 1, further comprising:

determining, based on the occupancy estimate, that there are no unauthorized occupants, including a person who invoked the restricted credentials, in the environment;

determining that the security system can be automatically changed from the second mode to the first mode; and automatically changing the security system from the second mode to the first mode.

4. The computer-implemented method of claim 1, further comprising:

determining, based on the occupancy estimate, that there are no unauthorized occupants, including a person who invoked the restricted credentials, in the environment;

determining that the security system cannot be automatically changed from the second mode to the first mode;

sending a request to change the security system from the second mode to the first mode to at least one computing device associated with a user of the security system;

receiving a response to the request to change the security system from the second mode to the first mode granting the request; and changing the security system from the second mode to the first mode.

5. The computer-implemented method of claim 1, further comprising:

determining, based on the occupancy estimate, that at least one unauthorized occupant is present in the environment after the expiration of the restricted credentials; and sending a notification of the presence of the at least one unauthorized occupant in the environment after the expiration of the restricted credentials and a request to extend the validity of the restricted credentials to at least one computing device associated with a user of the security system.

6. The computer-implemented method of claim 5, further comprising:

receiving a response to the request to extend the validity of the restricted credentials granting the request;

changing the expiration condition of the restricted credentials to extend the validity of the restricted credentials; and un-expiring the restricted credentials.

7. The computer-implemented method of claim 5, further comprising:

receiving a request to communicate with the at least one unauthorized occupant of the environment through one or more output devices distributed in the environment.

8. The computer-implemented method of claim 5, further comprising sending contact data for the at least one unauthorized person to the at least one computing device associated with the user with the notification of the presence of the at least one unauthorized occupant in the environment after the expiration of the restricted credentials and the request to extend the validity of the restricted credentials.

9. A computer-implemented system for security system re-arming comprising:

sensors, each sensor adapted to monitor an aspect of an environment and generate a signal;

and a hub computing device adapted to determine that restricted credentials used to change the security system of the environment from a first mode to a second mode are expired based on an expiration condition of the restricted credentials, determine that the security system is in the second mode that the security system was changed to based on the restricted credentials, receive one or more signals from the sensors, and generate an occupancy estimate for the environment based on the one or more signals from the sensors in response to determining that the restricted credentials are expired and the security system is in the second mode.

10. The computer-implemented system of claim 9, wherein the hub computing device is further adapted to determine, based on the occupancy estimate, that there are no unauthorized occupants, including a person who invoked the restricted credentials, in the environment, determine that the security system can be automatically changed from the second mode to the first mode, and automatically change the security system from the second mode to the first mode.

11. The computer-implemented system of claim 9, wherein the hub computing device is further adapted to determine, based on the occupancy estimate, that there are no unauthorized occupants, including a person who invoked the restricted credentials, in the environment, determine that the security system cannot be automatically changed from the second mode to the first mode, send a request to change the security system from the second mode to the first mode to at least one computing device associated with a user of the security system, receive a response to the request to change the security system from the second mode to the first mode granting the request, and change the security system from the second mode to the first mode.

12. The computer-implemented system of claim 9, wherein the hub computing device is further adapted to determine, based on the occupancy estimate, that at least one unauthorized occupant is present in the environment after the expiration of the restricted credentials, and send a notification of the presence of the at least one unauthorized occupant in the environment after the expiration of the restricted credentials and a request to extend the validity of the restricted credentials to at least one computing device associated with a user of the security system.

13. The computer-implemented system of claim 12, wherein the hub computing device is further adapted to receive a response to the request to extend the validity of the restricted credentials granting the request, change the expiration condition of the restricted credentials to extend the validity of the restricted credentials, and un-expire the restricted credentials.

14. The computer-implemented system of claim 12, further comprising one or more output devices, and wherein the hub computing device is further adapted to receive a request to communicate with the at least one unauthorized occupant of the environment through the one or more output devices.

15. The computer-implemented system of claim 12, wherein the hub computing device is further adapted to send contact data for the at least one unauthorized person to the at least one computing device associated with the user with the notification of the presence of the at least one unauthorized occupant in the environment after the expiration of the restricted credentials and the request to extend the validity of the restricted credentials.

16. A system comprising: one or more computers and one or more storage devices storing instructions which are operable, when executed by the one or more computers, to cause the one or more computers to perform operations comprising:

determining that restricted credentials used to change a security system of an environment from a first mode to a second mode are expired based on an expiration condition of the restricted credentials;

determining that the security system is in the second mode that the security system was changed to based on the restricted credentials;

receiving one or more signals from one or more sensors distributed in the environment; and generating an occupancy estimate for the environment based on the one or more signals from the one or more sensors in response to determining that the restricted credentials are expired and the security system is in the second mode.

17. The system of claim 16, wherein the instructions further cause the one or more computers to perform operations comprising:

determining, based on the occupancy estimate, that there are no unauthorized occupants, including a person who invoked the restricted credentials, in the environment;

determining that the security system can be automatically changed from the second mode to the first mode; and automatically changing the security system from the second mode to the first mode.

18. The system of claim 16, wherein the instructions further cause the one or more computers to perform operations comprising:

determining, based on the occupancy estimate, that there are no unauthorized occupants, including a person who invoked the restricted credentials, in the environment;

determining that the security system cannot be automatically changed from the second mode to the first mode;

sending a request to change the security system from the second mode to the first mode to at least one computing device associated with a user of the security system;

receiving a response to the request to change the security system from the second mode to the first mode granting the request; and changing the security system from the second mode to the first mode.

19. The computer-implemented method of claim 16, further comprising:

determining, based on the occupancy estimate, that at least one unauthorized occupant is present in the environment after the expiration of the restricted credentials; and sending a notification of the presence of the at least one unauthorized occupant in the environment after the expiration of the restricted credentials and a request to extend the validity of the restricted credentials to at least one computing device associated with a user of the security system.

20. The system of claim 19, wherein the instructions further cause the one or more computers to perform operations comprising:

receiving a response to the request to extend the validity of the restricted credentials granting the request;

changing the expiration condition of the restricted credentials to extend the validity of the restricted credentials; and un-expiring the restricted credentials.

* * * * *